United States Patent [19]

Grenell

[11] 4,154,444

[45] May 15, 1979

[54] GAME AND AMUSEMENT DEVICE

[75] Inventor: Nathan D. Grenell, Whitehall, Mich.

[73] Assignee: Robert L. McKellar, Midland, Mich.

[21] Appl. No.: 881,766

[22] Filed: Feb. 27, 1978

[51] Int. Cl.[2] ..... A63F 3/00

[52] U.S. Cl. ..... 273/273; 273/156

[58] Field of Search ..... 273/156, 273, 282, 155; 35/22 R

[56] References Cited

U.S. PATENT DOCUMENTS

| | | | |
|---|---|---|---|
| 591,146 | 10/1897 | Stannard | 273/155 |
| 1,494,876 | 5/1924 | Zander | 273/282 |
| 2,871,018 | 1/1959 | Fink | 35/22 R X |
| 3,061,313 | 10/1962 | Greene | 273/282 X |
| 3,375,009 | 3/1968 | Stubbmann | 273/156 |
| 3,815,918 | 6/1974 | Norvitch | 273/282 |
| 4,025,075 | 5/1977 | Priska | 273/282 X |

FOREIGN PATENT DOCUMENTS

| | | | |
|---|---|---|---|
| 125527 | 4/1919 | United Kingdom | 273/155 |

*Primary Examiner*—Harland S. Skogquist
*Attorney, Agent, or Firm*—Robert L. McKellar

[57] ABSTRACT

What is disclosed is a novel game which depends on both memory and skill. The game consists of a spinner apparatus for determining play and a series of perforated, patterned discs and colored pegs which gives both a chance selection and chance peg insertion which gives the game ever-changing characteristics.

1 Claim, 5 Drawing Figures

GAME AND AMUSEMENT DEVICE

BACKGROUND OF THE INVENTION

Figure 1:
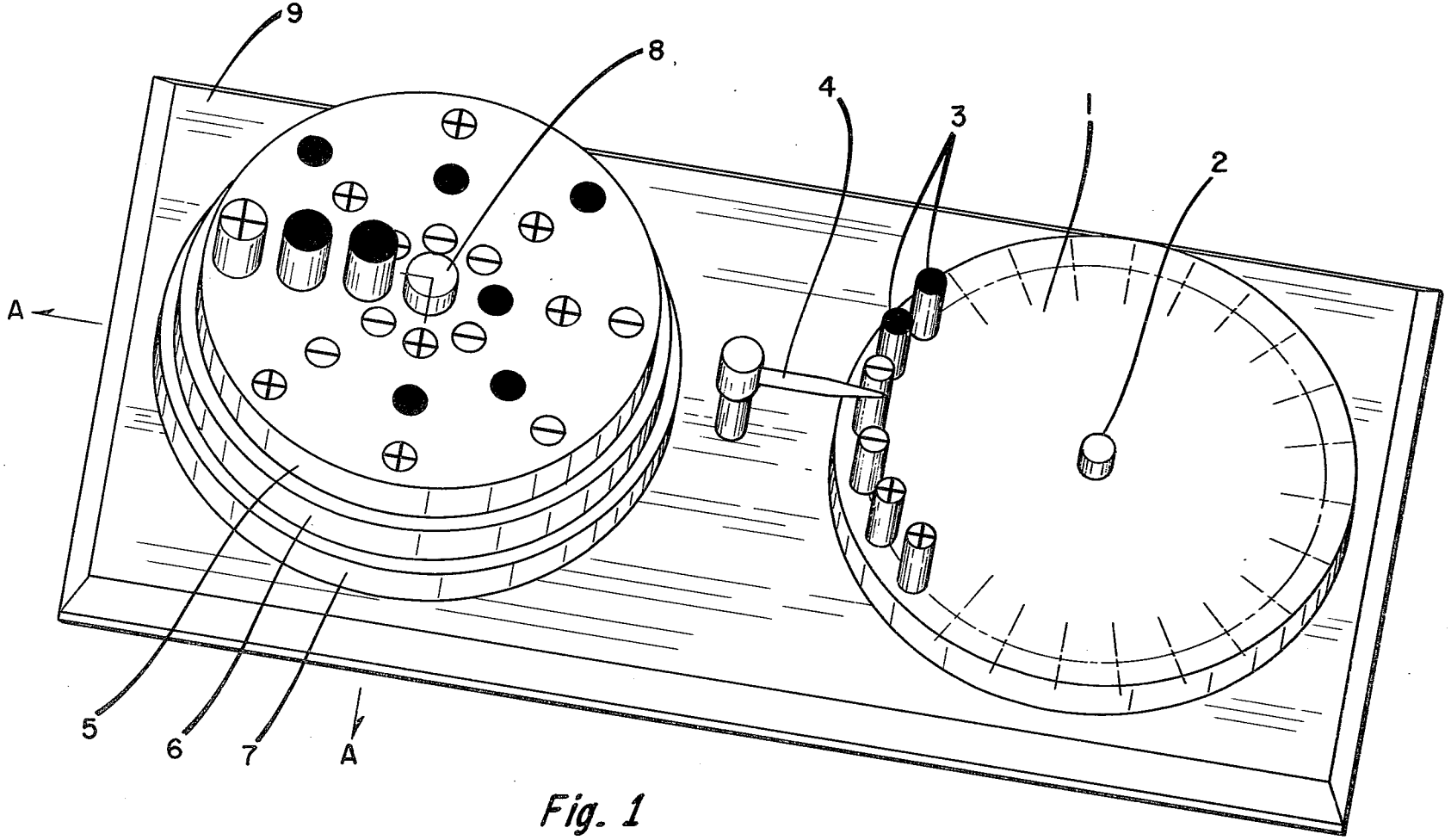

The present invention relates to a game which can be utilized by both young and older persons to amuse themselves. This game is unique in that the playing pattern changes consistently so that the younger quicker minds cannot easily master its details. For the older gameplayer, however, the game has a high interest quotient because it has a chance selection mechanism as well as a chance peg insertion mechanism.

Games utilizing pegs are very old as evidenced by the numerous peg games available on the shelves of many retail stores.

Also, many games have been provided which give a chance selection to the players. There have also been many games which give the player chance peg insertion. Both of these approaches to games in general have provided games which, although entertaining, have a tendency to become extraordinarily uninteresting after a short period of play time.

Such games are illustrated for example in U.S. Pat. No. 2,283,583, issued May 19, 1942 to H. Singer. Such a device is a "chance selection" device and depends for its novelty on a plurality of rotating discs which rotate around a center axis and which have a stationary indicator associated with each disc. The object of the game is to pre-select numbers or objects on the rotating discs and betting on such numbers or objects. If the preselected number or object appear under the stationary indicator after the discs have been spun, the person selecting such number or object is the winner.

As an example of a chance peg insertion game or device, one can turn to U.S. Pat. No. 2,871,018 issued Jan. 27, 1959 to Lauretta Fink. The device consists of a hollow cup surmounted by a removable cover which has at least one aperture therethrough.

Pegs are then passed through the aperture or apertures, as the case may be, and the manipulation of the pegs through the aperture is allegedly a test of skill. The pegs can be colored and the aperture sizes varied in order to provide additional skills to the game.

A further peg insertion game can be found in U.S. Pat. No. 3,612,537 which consists of a hexahedral hollow body whose walls are provided with through-holes numbered from 1 to 6. Rods are provided which are adapted to be inserted into the through-holes. The rods are of varying length and the object of the game is to place each rod in the correct hole without causing interference with any other rod. It is obvious that this game could be mastered in a very short time by simple memorization.

Another peg game which relys on peg insertion is shown in U.S. Pat. No. 3,834,708 issued Sept. 10, 1974 to Philip L. Shoptaugh. This game has an objective of forming tight clusters of pegs of the same length. The game consists of a gameboard which has holes in it of differing depths and pegs of different lengths. The players in a series of moves attempt to get their pegs in a tight cluster with the pegs all extending the same heighth above the board.

Finally, there is shown in U.S. Pat. No. 3,061,313, a game apparatus which simulates the drilling of wells. The object of the game is to insert a single peg through perforated plates until the proper perforation is pegged. The plates are pre-aligned to give a series of aligned holes and misaligned holes. Some aligned holes are electrically activated so that the insertion of the proper peg will activate an electrical circuit to light an electric bulb. Such a bulb when lit indicates a score i.e. a simulated oil pocket has been hit. This game, although very novel, requires only a chance peg insertion and is subject to memorization by the players.

THE INVENTION

It has now been discovered that the interest of such like devices can be enhanced by the combination of a chance peg insertion and a chance selection of both pegs and hole alignment.

It is an object of this game to provide a game combining chance and skill such that there are multiple memory patterns so that the game is not easily mastered and is exceptionally difficult to memorize resulting in infinite play patterns which lead to great amusement for the players. This game can readily be manufactured at low cost from available materials such as wood, metal, plastics and the like.

The inventive game consists of a gameboard surmounted by both a series of stacked, variable diameter, perforated discs and a spinner apparatus and, a series of colored or numbered pegs of varying lengths.

The ancillary objects and features of the invention will become apparent as the following description proceeds.

What is illustrated in FIG. 1 is a game or device which consists of a spinner disc 1 which is a flat disc with a central vertical stable axis 2 and a series of evenly spaced colored or numbered pegs 3. In addition, there is a spinner flapper 4 which serves to slow down and stop the spinner 1 and which also serves as an indicator to determine which numbered or colored peg is chance selected by the spinning of the disc. The entire spinner disc and spinner flapper is analogous to the well-known roulette wheel.

Adjacent to the spinner disc and flapper is a series of flat discs 5, 6 and 7 which have perforations in them and which are aligned on a central stable axis 8. These discs are freely rotatable independently of each other and the gameboard on the stable center axis 8. The gameboard 9 has holes or indentions bored in it directly underneath the discs 5, 6 and 7 which correspond to a certain pattern. The discs 5, 6 and 7 have perforations which follow the pattern in the gameboard 9 but have, in addition, numerous other perforations as will be discussed later.

Figure 2:
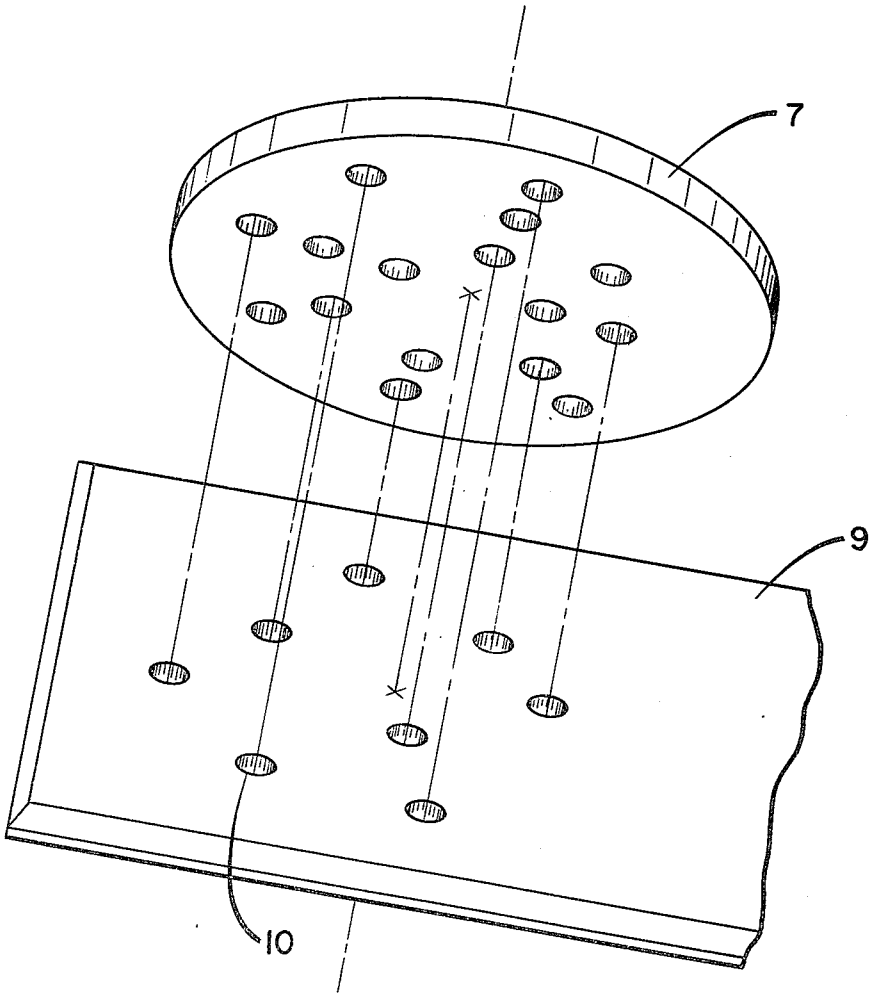

FIG. 2 illustrates an exploded view of a portion of the gameboard 9 and the disc 7 to further illustrate the perforations and the alignment of the disc 7 and the gameboard 9. The disc 7 is illustrated as being tipped up slightly so that the bottom of the disc 7 and the top of the gameboard 9 can be seen.

FIG. 2 shows a typical pattern of indentions 10 in the gameboard which are all of the same depth. The broken lines in FIG. 2 show the same pattern in disc 7 and other perforations in addition thereto.

Figure 3:
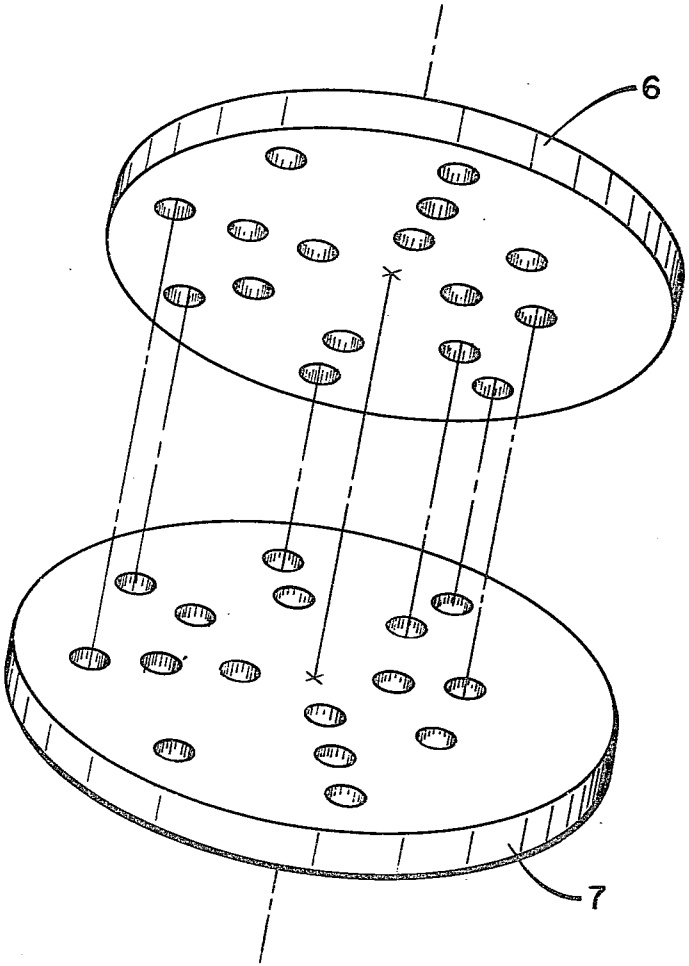

FIG. 3 shows an exploded view of the discs 6 and 7 in which is illustrated the pattern of the gameboard indentions and additional perforations in each. Disc 6 is illustrated in a slightly tipped-up view to show the bottom while the disc 7 is shown in a slightly tipped down view to show the top.

Figure 4:
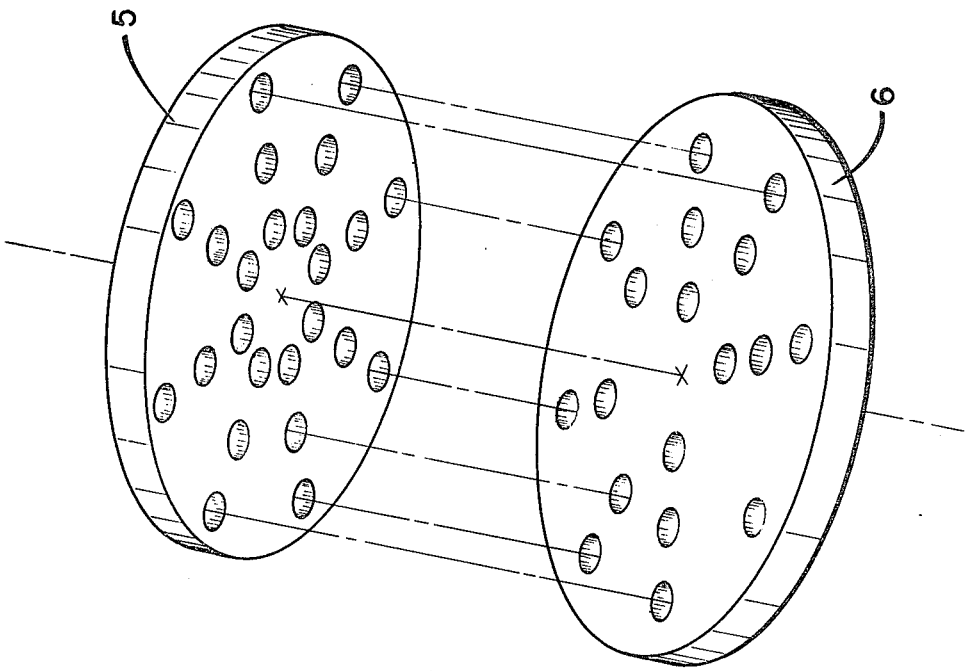

FIG. 4 illustrates an exploded view of discs 5 and 6. Disc 5 is tipped up slightly and disc 6 is tipped down slightly to show the alignment of the perforations and the additional holes therein.

Figure 5:
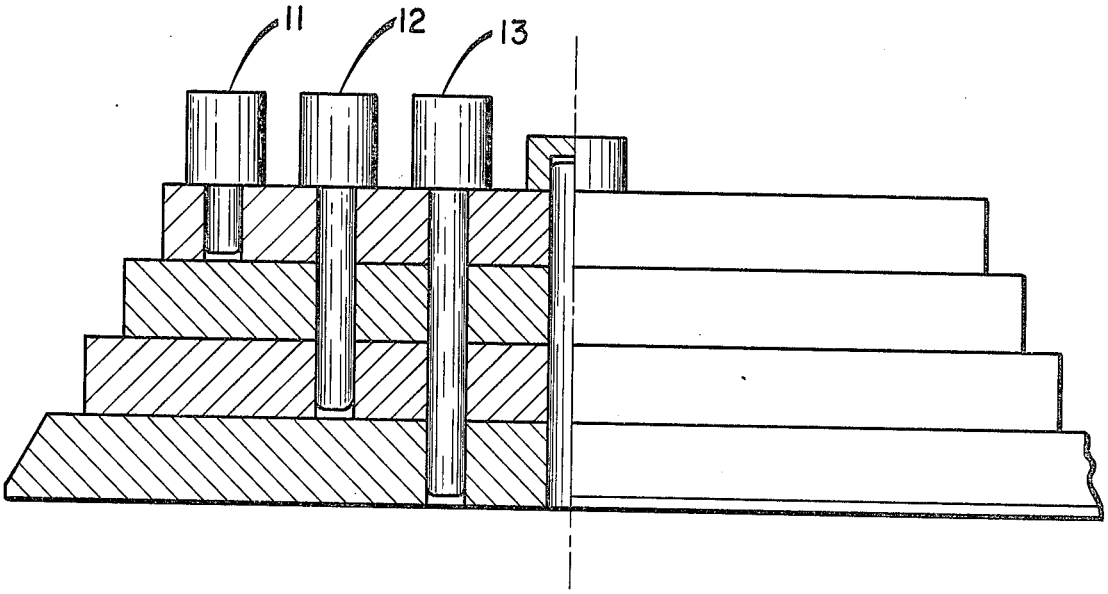

FIG. 5 is a cut through the assembled game of FIG. 1 at the lines AA of the stacked perforated discs and illustrates the variable length pegs 11, 12 and 13, and their position in the stacked discs and the indentions in the gameboard.

The pegs 11, 12 and 13 are numbered or colored to correspond to the numbers or colors of the pegs 3 shown in FIG. 1.

Since there are three pegs 11, 12 and 13, the spinner disc should contain pegs which have three different colors. For example, on a typical game, the spinner disc is approximately five inches in diameter and contains twenty-four pegs around its outer periphery (see FIG. 1). Since three colors are required and since there should be an equal number of each color, our example spinner disc would have, say, eight red pegs, eight green pegs and eight black pegs which are randomly placed about the periphery of the disc. When the spinner disc is spun, the flapper 4 slows the disc down and the flapper comes to rest against one of the colored pegs 3.

In actual play, the pegs 11, 12 and 13 are withdrawn from the holes in the discs 5, 6 and 7 and laid aside to be used as the game progresses. The discs 5, 6 and 7 are then randomly spun to misalign the holes in them. The first player then spins the spinner disc and when it comes to a stop, the peg color indicated by the flapper is selected by the player from the peg pile of 11, 12 and 13 pegs. The player then inserts that peg in the perforated discs. The player is allowed to rotate the perforated discs in any direction any number of times in order to insert the peg. Obviously, if one of the short pegs has been indicated by the spinner disc and flapper, the perforated discs needn't even be moved. Once the peg has been inserted in a hole and the player declares that it will remain there, then the turn at play is finished. Each player in turn plays in this manner until all the pegs are in the perforations or, the pegs will no longer fit, that is, during play, the deepest holes may have been inadvertantly filled by using the shorter pegs. The game can be scored a number of different ways such as assigning the pegs 11, 12 and 13 with numbers prior to play or, the game can be scored by simply keeping track of the pegs and counting the number each player has played.

In the working model, the pegs are 3", 2" and 1½" in length and are arbitrarily assigned a value of 20, 15 and 5 points each. The longest peg 13 is long enough to go through the perforated discs 5, 6 and 7 and fill the indention in the gameboard thereby locking all the discs in place so that they will not rotate. The 2" peg is just long enough to go through the perforated discs 5, 6 and 7 but it will not reach into the indentation of the gameboard. Thus, if a 2" peg is played it will lock the discs together but it will not lock the discs to the gameboard. The 1½" peg will not lock any discs together or will not lock the discs to the gameboard. Thus, if a 3" peg is played first in the game, the advantage of having movable discs during the remainder of the game is foreclosed. If a 2" peg is played first the entire stack of perforated discs is movable but the separate discs will not be independently rotatable from the other discs. If a 1½" peg is played first the entire stack of discs is rotatable on the gameboard and independently of each other.

Thus, it can be readily observed that there are many variables to the game which make it difficult to memorize and therefore the game remains interesting. There is random selection by way of the spinner disc. There is random selection by way of each movable perforated disc and there is random peg selection. There is only one alignment that will allow the insertion of all of the pegs.

Minor modifications and changes are within the scope of the claim and the description above is not intended to limit the scope of this invention. For example, a fourth rotatable, perforated disc could be added to the stacked discs to increase the complexity of the game.

That which is claimed is:

1. A game apparatus comprising a gameboard, a stack of rotatable, perforated discs, an assortment of pegs of varying lengths, a spinner disc and a flapper-indicator, said gameboard containing indentations in one end of its upper surface in a certain pattern, the gameboard surmounted above the certain pattern by a stack of perforated discs wherein some of the perforations are aligned with the certain pattern in the gameboard, said perforated discs being independently rotatable around a center axis; said spinner disc being horizontally mounted on its flat side on the surface of the gameboard and adjacent to said stack of perforated discs, said spinner disc being freely rotatable about a center axis and said spinner disc containing multiple pegs upon the upper surface and around the outer periphery thereof; said flapper-indicator being mounted on the gameboard between the stack of rotatable, perforated discs and the spinner disc in such a manner that the tip of the flapper-indicator touches the pegs of spinner disc; the assortment of pegs being of the same number as the perforations in the stack of perforated discs and having such lengths such that a portion of the assortment of pegs is as long as the thickness of the uppermost disc, a portion of the assortment of pegs is as long as the combined thickness of the stack of rotatable discs and a portion of the assortment of pegs is as long as the combined thickness of the stack of rotatable discs and some length longer for insertion into the indentions in the gameboard.

* * * * *